US005224683A

United States Patent [19]

Richeson

[11] Patent Number: 5,224,683

[45] Date of Patent: Jul. 6, 1993

[54] HYDRAULIC ACTUATOR WITH HYDRAULIC SPRINGS

[75] Inventor: William E. Richeson, Fort Wayne, Ind.

[73] Assignee: North American Philips Corporation, New York, N.Y.

[21] Appl. No.: 848,807

[22] Filed: Mar. 10, 1992

[51] Int. Cl.[5] ..... F16K 31/124

[52] U.S. Cl. ..... 251/30.01; 251/47; 251/48; 251/63.5; 123/90.12

[58] Field of Search ..... 251/30.01, 47, 48, 129.1, 251/63.5; 123/90.12

[56] References Cited

U.S. PATENT DOCUMENTS 4,974,495 12/1990 Richeson, Jr. ..... 123/90.12 X 5,058,538 10/1991 Erickson et al. ..... 123/90.12

*Primary Examiner*—John Rivell

*Attorney, Agent, or Firm*—Robert J. Kraus

[57] ABSTRACT

Movement of a main valve between first and second stable positions is dependent upon hydraulic pressure controlled by an electrically controlled pilot valve reciprocable between first and second stable positions. When the pilot valve is in its first stable position, high pressure hydraulic fluid is admitted to a primary accumulator, while the working piston of the main valve is exposed only to low pressure, thereby maintaining the main valve in its first stable position. When the pilot valve is in its second stable position, the primary accumulator communicates with the working piston so that expanding hydraulic fluid acts ont he working piston to drive the main valve to its second stable position. A secondary accumulator communicating with the bores of said main valve and pilot valve, together with pistons or the valve stems, provide hydraulic springs urging the pilot valve and main valve toward their first stable positions.

10 Claims, 6 Drawing Sheets

HYDRAULIC ACTUATOR WITH HYDRAULIC SPRINGS

BACKGROUND OF THE INVENTION

The invention relates to a hydraulically powered valve actuator which is triggered to move between first and second stable positions by an electrically controlled pilot valve.

U.S. application Ser. No. 820,470 filed Jan. 14, 1992 and incorporated herein by reference discloses a resilient hydraulic actuator wherein the engine valve carries a single piston with opposed working surfaces which are alternately exposed to high pressure hydraulic fluid to shuttle the engine valve between first and second stable positions. When the main valve is in its first stable position (engine valve closed), a first fully charged spring chamber is isolated from a first working surface of the piston by a closed electrically actuated valve $V_1$. Meanwhile, a second working surface of the piston is directly connected to a high pressure source via open valve $V_3$, while a second spring chamber is connected to a lower pressure source via open valve $V_4$ and disconnected from the working surface by a closed valve $V_2$.

The valves $V_2$, $V_3$, and $V_4$ are on a common electrically controlled spool valve (pilot valve) and are therefore switched simultaneously so that the high pressure source is isolated from the second working surface ($V_3$ closed), while the second spring chamber is isolated from the low pressure source ($V_4$ closed) and connected to the first working surface of the piston ($V_2$ open). High pressure from the first spring chamber then acts on the first working surface of the piston via a check valve to move the engine valve toward its second stable position, thereby increasing the pressure in the second spring chamber to provide damping. The momentum of the valve completes movement to the second stable position as pressure in the second spring chamber is maximized and pressure in the first spring chamber is minimized. Return movement is triggered by opening valve V, to release pressure from the first working surface of the piston back into the first spring chamber, followed by again switching the valves $V_2$, $V_3$, and $V_4$ to complete the movement and latch the valve in the first stable position.

The actuator disclosed in U.S. Ser. No. 820,470 represents an important advance in electrically controlled hydraulically powered valves, insofar as it recognizes that compressibility of the hydraulic fluid may be used to create a spring for driving the valve and for damping its movement. However, two discrete solenoid actuated pilot valves are required, and the housing with its numerous internal passages is complex to manufacture.

SUMMARY OF THE INVENTION

The present invention utilizes only one electrically actuated valve having two stable positions, which valve controls transfer of hydraulic fluid to drive the engine valve between two stable positions. High pressure hydraulic fluid from a high pressure source is used to step up the pressure in a primary accumulator when the pilot valve is in a first position and the engine valve is closed. The high pressure source is never directly connected to the working piston which moves the main valve, wherefore response time to repressurize the accumulators is not a major concern for effecting a fast transfer of the main valve. It is only necessary that high pressure is re-established during the time the engine valve is closed, which time is relatively large compared to the time the valve is open. Since only a few cubic centimeters of hydraulic fluid are being transferred, proximity of the source, i.e. length of the line, are not dominant design factors.

When the pilot valve is electrically actuated and thus moved to its second stable position, the communication between the high pressure source and the primary accumulator is interrupted, while a transfer port between the accumulator and the working piston on the main valve is opened. The transfer port, which includes a check valve, is of short length and large cross sectional area to permit rapid fluid transfer to the working chamber which expands to drive the piston, thus providing a very fast response for opening the valve. Fluid transfer is effected exclusively by expansion of hydraulic fluid in the primary accumulator, which may in fact be several interconnected cavities in the housing. This permits an extremely fast response.

As the fluid in the primary accumulator expands to drive the first or working piston on the main valve to its second stable position, a second piston further up the stem of the valve moves into a spring chamber which is part of a secondary accumulator isolated from the primary accumulator. This increases the pressure in the spring chamber to provide damping for the engine valve toward the end of its opening movement, and further provides a return force for the engine valve when pressure in the working chamber is released. Insofar as the opening of the engine valve stores energy for its return, conservation of energy (conversion from kinetic to potential) is achieved.

When the pilot valve is electrically actuated for return to its first stable position, the working chamber is connected to a low pressure port, thereby releasing hydraulic pressure so that pressure in the spring chamber on the second piston drives the engine valve back to its first stable position. This movement is aided by a coil spring loaded against a keeper on the valve stem in the spring chamber.

The secondary accumulator system also includes a pilot spring chamber with a similar piston arrangement which causes a pressure build-up which loads the pilot valve toward its first stable position when it is in its second stable position. A coil spring loaded against a keeper on the stem of the pilot valve provides a force loading the pilot valve toward its second stable position when it is in its first stable position. The hydraulic and mechanical springs on the pilot valve therefore serve to accelerate the pilot valve when the opposing magnetic latches trigger its release.

The actuator therefore achieves a high degree of energy conservation in an assembly having only two moving parts.

DETAILED DESCRIPTION OF THE PREFERRED EMBODIMENTS

Figure 1:
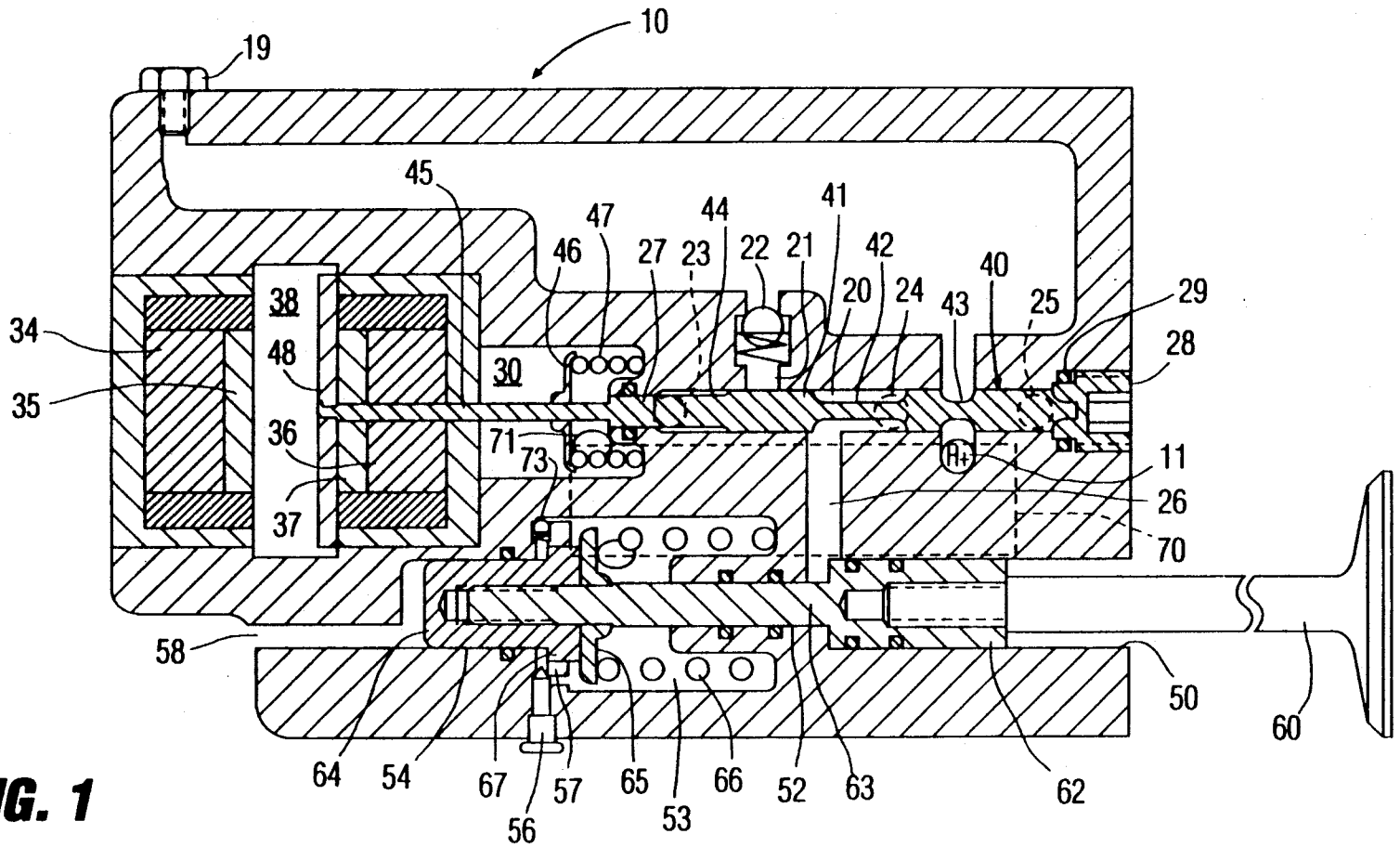
FIG. 1 is an axial section showing the magnetically actuated pilot valve in the position which admits high pressure fluid to the accumulators, and the main valve in the closed position.
Figure 2:
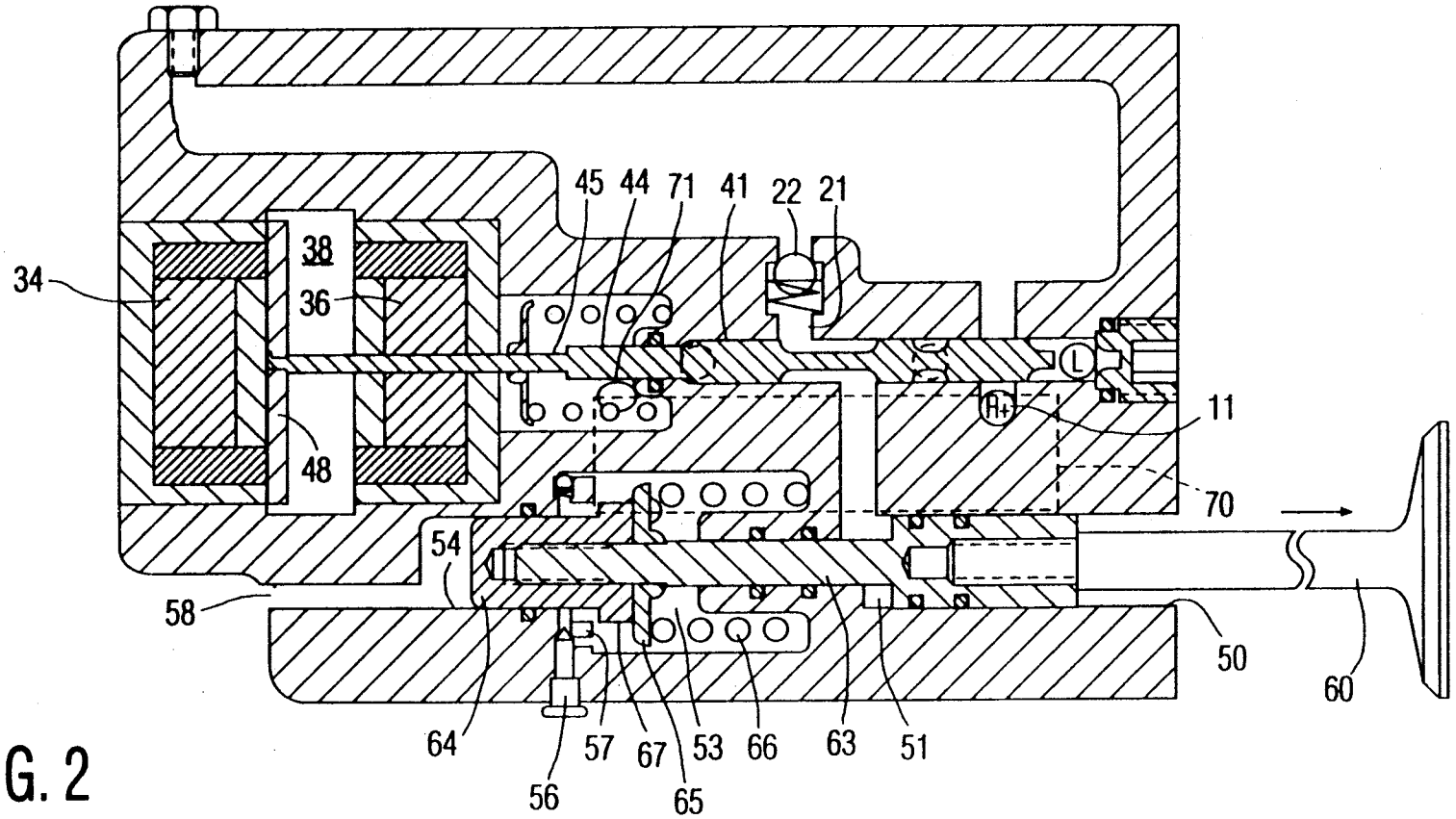
FIG. 2 is an axial section as in FIG. 1 showing the pilot valve in the position which admits high pressure fluid from the accumulators into the working chamber for the main valve.
Figure 3:
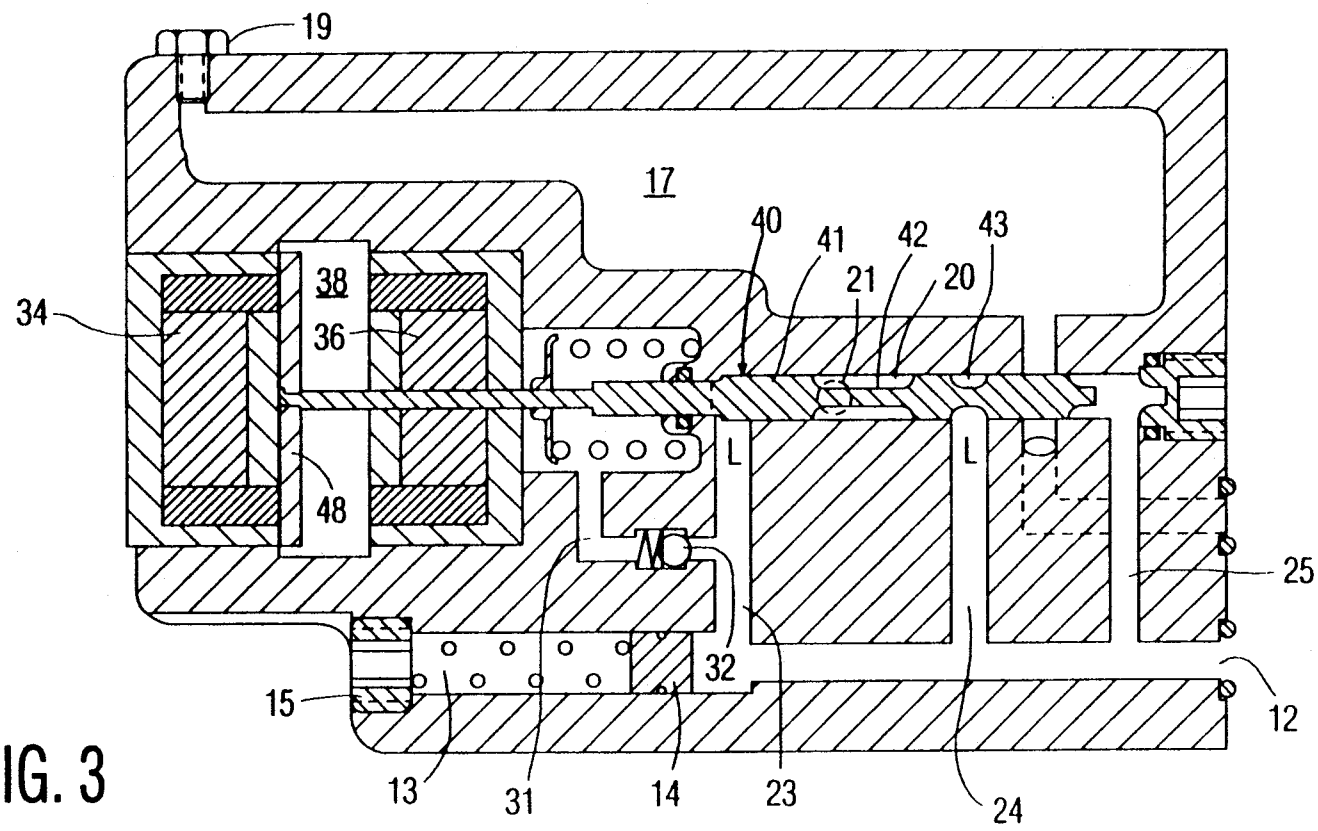
FIG. 3 is an axial section orthogonal to FIGS. 1 and 2, showing the pilot valve in the same position as FIG. 2.
Figure 6:
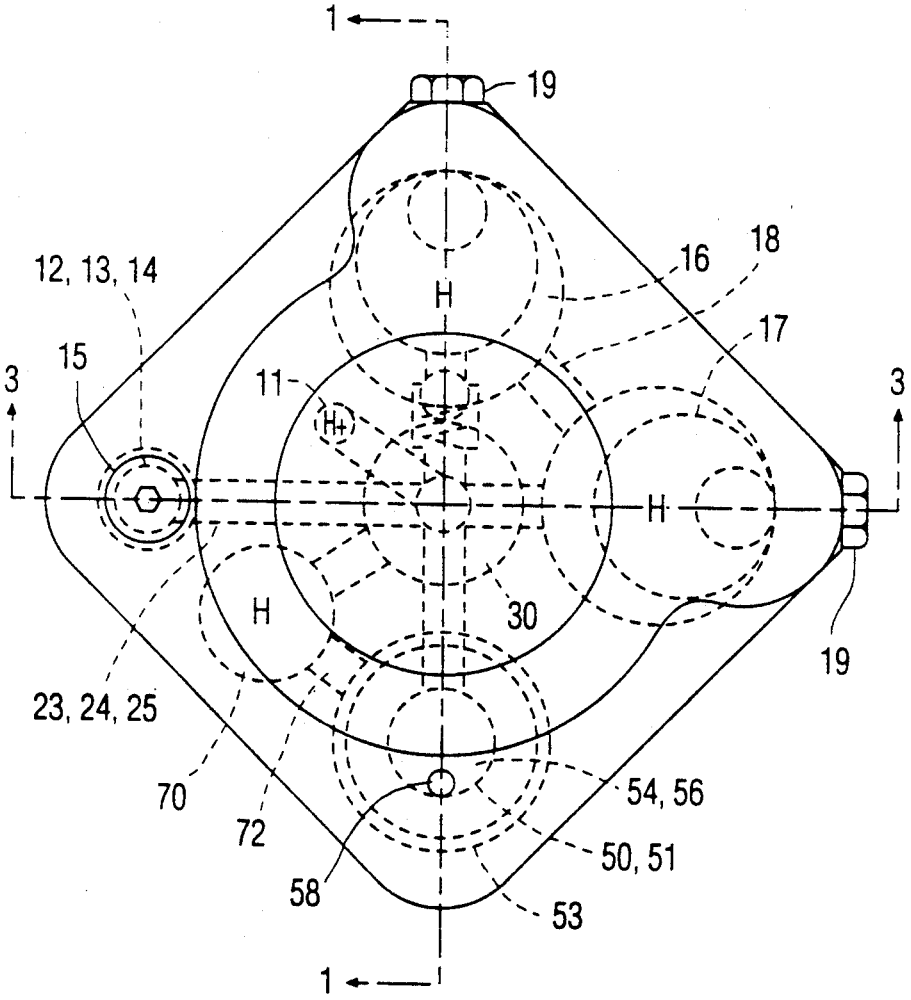
FIG. 6 is an end view wherein the line 1—1 represents the section of FIGS. 1, 2, 4, and 5 while line 3—3 represents the section of FIG. 3.

FIG. 1 is an axial side section of the valve actuator assembly taken along line 1—1 of FIG. 6, while FIG. 3 is an axial section taken along line 3—3 of FIG. 6 at a point in time corresponding to the section of FIG. 2.

Taken collectively, FIGS. 1, 3, and 6 show an investment cast housing 10, a galley 11 connected to a source of constant high pressure, and a galley 12 connected to a source of constant low pressure. A pilot bore 20 carries a pilot valve 40 in the form of a spool valve which provides the fluid switching necessary to cause reciprocation of the engine valve 60. The pilot valve 40 has a main body 41, a first constriction 42, and a second constriction 43 in the pilot bore 20, which is closed at the right hand end by a threaded plug 28 having a hex socket for flush mounting. The body 41 has a damping profile 49 received in a like profiled recess in the plug 28; this slows the pilot valve in its final stage of rightward movement to the position shown in FIG. 1. A seal 29, like similar seals elsewhere in the device, prevents leakage.

The opposite end of the pilot valve 40 carries an armature in the form of a ferrous disc movable through a gap 38 between two magnets 34, 36 in the housing. These may be electromagnets energized as solenoids or permanent magnets briefly overridden by pulsed magnetic fields as described in U.S. Pat. No. 4,883,025 In either case the principle is one of valve actuation by electrical pulses timed by a central engine computer as described in U.S. Pat. No. 4,945,870.

In the position of FIG. 1 the second constriction 43 permits fluid communication between the high pressure conduit 11 and the first and second primary accumulators 16, 17 which are located in respective quadrants of the housing 10 and connected by a conduit 18. The conduit 11 is connected to a source of hydraulic fluid at 2500 psi so that the accumulators also reach 2500 psi. The only outlet from the primary accumulators 16, 17 is through check valve 22 and supply port 21 to the pilot bore 20, but this is blocked by the valve body 41.

The pilot valve 40 includes a first piston 44 which is received though the sealed guide bore 27, and a stem 45 of smaller diameter to which a keeper 46 for coil spring 47 is fixed. The difference in diameter of piston 44 and stem 45 causes a rightward spring force due to hydraulic pressure in the spring chamber 30, as will be described in greater detail hereinafter. This hydraulic spring force together with the force of attraction between disc 48 and magnet 36 is sufficient to overcome the opposing force of coil spring 47.

The engine valve 60 is fixed to a first or working piston 62 in working bore 50 of the housing. The first piston 62 is integral with a stem 63 which is received through a sealed guide bore 52. The annular face between first piston 62 and the stem 63 provides a working surface for fluid pressure which urges piston 62 rightward. In the first stable position shown in FIG. 1, however, the transfer port 26 is connected to a low pressure relief port 24 via primary constriction 42 so that no rightward force is present.

The stem 63 is in turn fixed to a second piston 64 and carries a keeper 65 for a coil spring 60 in the spring chamber 53. The difference in diameter between stem 63 and second piston 64 causes a leftward (valve closing) spring force due to the hydraulic pressure in spring chamber 53. This hydraulic spring force acts in concert with the force of coil spring 66 to maintain the engine valve 66 closed until high pressure is introduced to transfer port 26.

Note in conjunction with the end view of FIG. 6 that the pilot spring chamber 30 and the main spring chamber 53 are connected to a secondary accumulator 70 via respective access ports 71, 72, thereby forming a closed system at common hydraulic pressure.

The step 67 on second piston 64 in conjunction with annular channel 57 in the housing 10 serves as a damping mechanism to slow leftward or closing movement of the engine valve 60, thus preventing hammering of the valve seat. A needle valve 56 permits adjusting flow of hydraulic fluid from the annular space between the step 67 and the channel 57, whereas ball check valve assembly 73 removes this damping on reverse motion thereby regulating the damping. The space to the left of piston 64 is occupied by air which flows freely through port 58.

FIG. 2 shows the pilot valve 40 shifted to the position necessary to effect opening of the engine valve 60, whereby the transfer port 26 receives high pressure hydraulic fluid from accumulator 16 via check valve 22, supply port 21, and first constriction 42 of the pilot valve. This movement is effected by the magnets 34, 36 on command from the central computer which controls the valve timing. The forward and backward motion of pilot valve 40 is damped by way of the changes in diameter at piston 44 and damping profile 49, and the last minute venting thru apertures 23 and 25 respectively which reduces the impact velocity of armature 48 against the pole pieces 35, 37.

High pressure hydraulic fluid from transfer port 26 causes expansion of a working chamber 51 at the left end of main bore 50 while piston 62 moves rightward. Insofar as the high pressure supply conduit is now shut off by the pilot valve body 41, the primary accumulators 16, 17, the ports 21, 22, and the working chamber 51 form a closed system wherein the expanding hydraulic fluid acts as a hydraulic spring acting on the piston 62.

Note, however, that the force of the expanding fluid in working chamber 51 must be sufficiently great to overcome the counteracting force of the fluid being compressed in the closed system formed by spring chambers 30 and 53 and the second accumulator 70.

In order to obtain the necessary spring force for the desired valve lift, then, the volume of the accumulators 16, 17 and the size differential of piston 62 and stem 63, as well as the volumes of the spring chambers 30, 53 and the secondary accumulator 70, and the size differential of stem 63 and piston 64, must be carefully determined. For example, if the diameter of first piston 62 is 0.4 in and the diameter of second stem 63 is 0.18 in., the area difference is 0.1 sq. in. This means that the beginning force (at 2500 psi) is 250 lbs. If the required lift is 0.4 in., then the fluid must expand 0.04 cu. in. If the force required to compress the fluid in the spring chambers 30, 53 is 100 lb., then the end pressure in working chamber 51 must be 1000 psi for a pressure decrease of 1500 psi (150 lb.).

To determine the volume of the primary accumulators, the following relationship applies:

$$\Delta F=(\Delta v/v)KA$$

where $\Delta F=150$ lb., $\Delta v=0.04$ cu. in., $A=0.1$ sq. in., and $K=$bulk modulus$=250\times10^3$. This yields $v=6.67$ cu. in. or 3.33 cu. in. per primary accumulator. Similar calculations apply for balancing the volume of the secondary accumulator and the diameters of the stem 63 and second piston 64, as well as pistons 44, 45 and the associated spring chambers. Compressibility of hydraulic fluid is discussed further in U.S. application Ser. No. 07/715,069 (allowed), incorporated herein by reference.

FIG. 3 is an axial section orthogonal to that of FIG. 2 at the same instant in time. The low pressure supply conduit 12 communicates with a spring loaded piston 14 in bore 13; this piston retracts as soon as the system exhausts fluid from cavity 51, thereby introducing a near constant low pressure of about 100 psi in the low pressure return line 12, thereby serving as a low pressure accumulator. The spring is retained in the bore by a threaded plug 15 having an open hex socket which permits passage of air therethrough. The low pressure relief ports 23, 25 simply provide an outlet for fluid in opposite ends of the pilot bore 20, while the port 24 provides relief for fluid in the working chamber 51 (FIG. 2) when the pilot valve 40 returns to the position of FIG. 1.

Due to the difference in diameters of stem 63 and piston 64 of the main valve and the pistons 44, 45 of the pilot valve, the pressure in spring chambers 53, 30 will be at a maximum when the main valve is fully open (FIG. 4) and the pilot valve is fully leftward (FIGS. 2 and 3). Likewise, when the engine valve 60 is fully closed (FIG. 1) and the pilot valve 40 is fully rightward (FIG. 1) the pressure in the system comprising chambers 53, 30 and secondary accumulator 70 is at a minimum. If this pressure is less than that in the low pressure supply conduit 12, make-up fluid will be admitted to chamber 30 via check valve 32 and make-up port 31.

Figure 4:
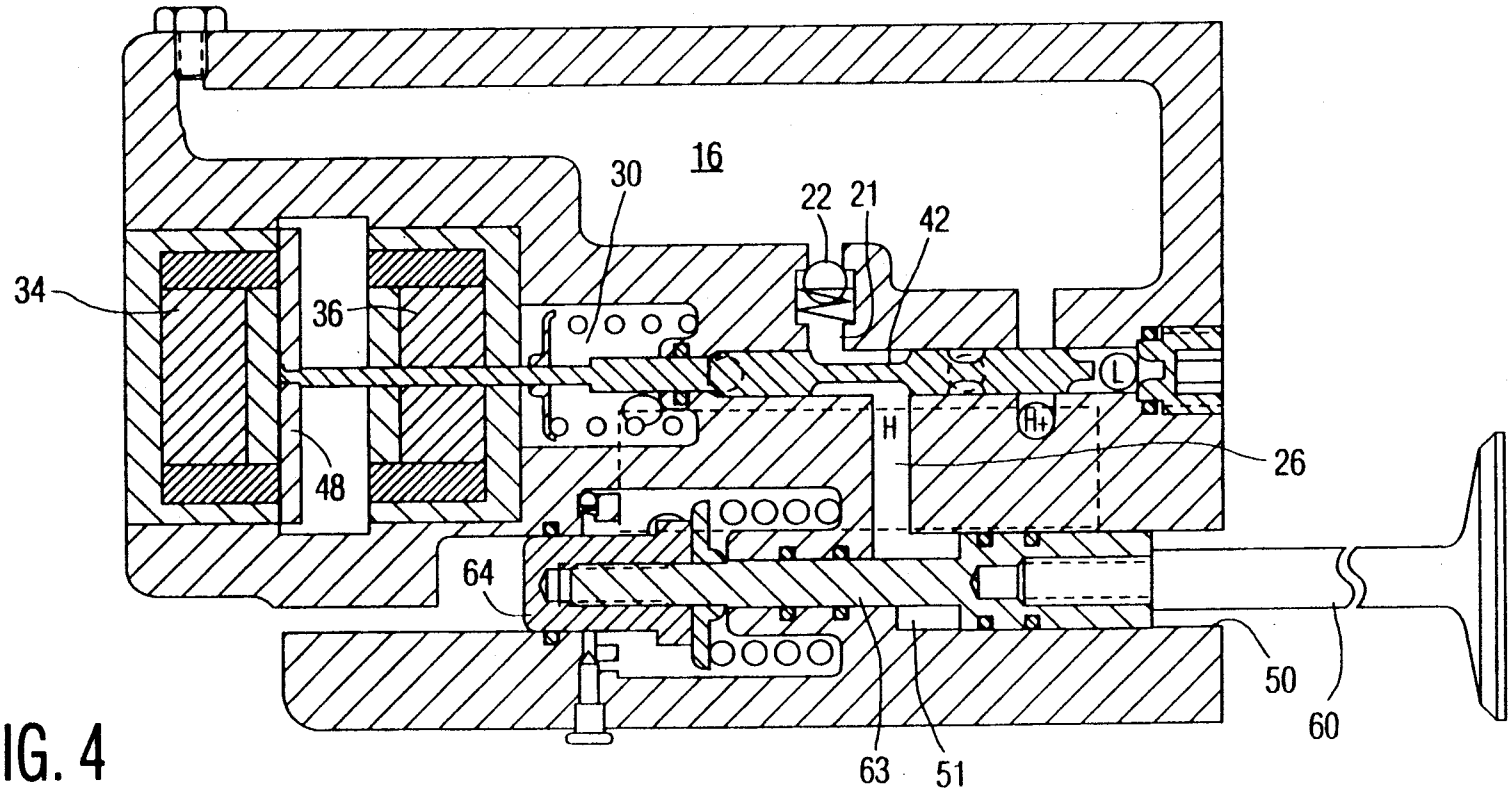
FIG. 4 is an axial section as in FIG. 2 showing the main valve in the fully open position.

FIG. 4 is similar to FIG. 2 insofar as the pilot valve 40 is still in the position which permits fluid transfer from primary accumulators 16, 17 to transfer port 26 via constriction 42. However, the engine valve 60 is now fully open, i.e. in its second stable position, and the working chamber 51 reaches its maximum volume. This causes the fluid transfer to stop, whereupon the check valve 22 closes so that the engine valve 60 remains open until the magnets 34, 36 are energized to effect rightward movement of the pilot valve 40. At this stage the fluid pressure in chamber 53, and thus the leftward hydraulic spring force on valve 60, is at a maximum. However, this maximum is still considerably less than the pressure in working chamber 51.

Figure 5:
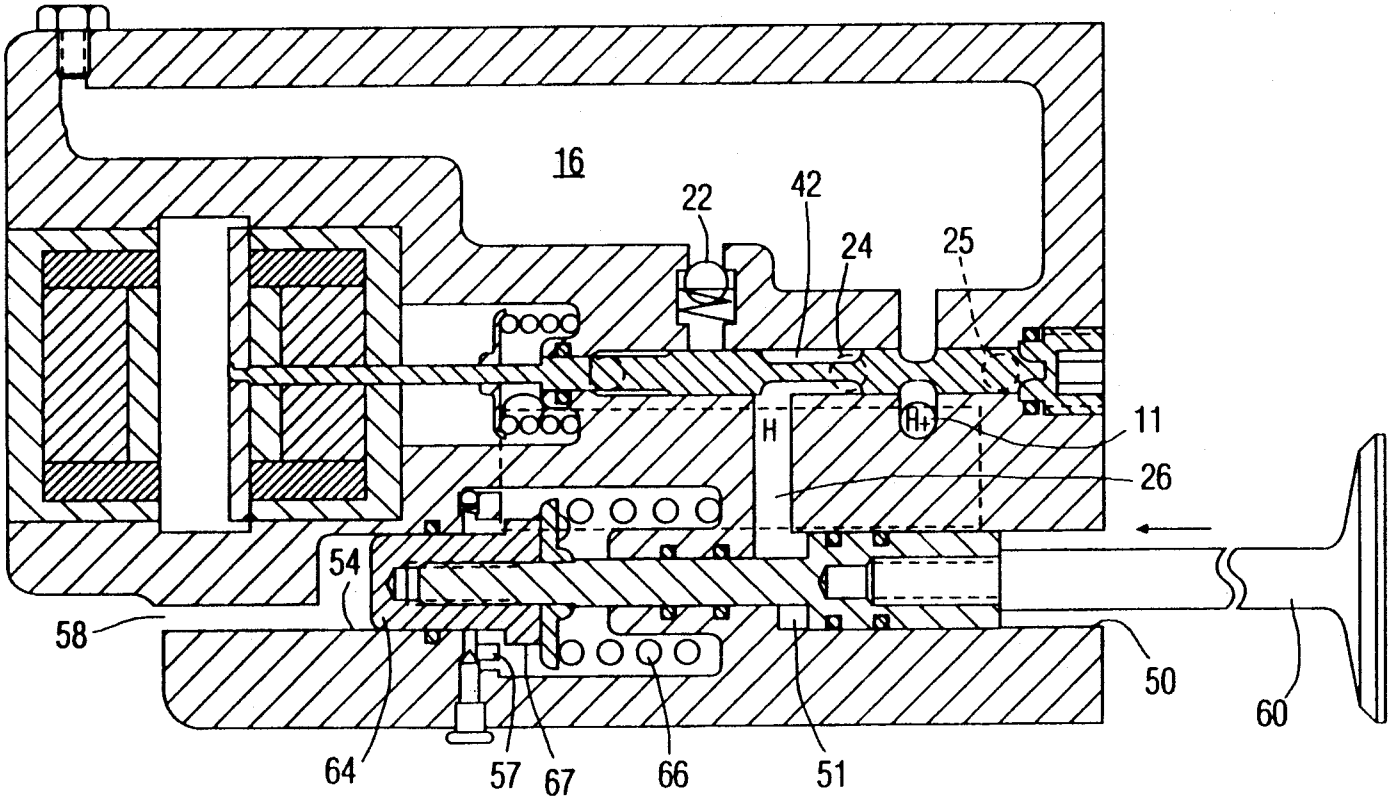
FIG. 5 is an axial section as in FIG. 4 showing the pilot valve in the position which releases high pressure fluid from the working chamber for the main valve.

FIG. 5 shows the pilot valve 40 once again shifted rightward to its initial position, aided by the hydraulic pressure in the pilot spring chamber 30. The constriction 42 now permits fluid communication between the transfer port 26 and the relief port 24 connected to low pressure galley 12 so that the hydraulic pressure in working chamber 51 drops and the valve 60 closes. Initial acceleration is quite high due to the hydraulic pressure in main spring chamber 53 as well as the full compression of coil spring 66. However, as the second piston 64 moves leftward in spring bore 54, the hydraulic pressure in chamber 53 drops to its minimum, and finally the closing movement is damped as the damping profile 67 enters the annular channel 57 in the housing. At this point the chamber 51 will have fully collapsed, and the system is once again in the position of FIG. 1. At this point the primary accumulators 16, 17 are recharged as previously described, however the main valve 60 will remain closed until the magnets 34, 36 are oppositely polarized (in the case of solenoids) or interrupted (in the case of permanent magnet latches).

FIG. 6 was discussed briefly in conjunction with FIGS. 1 and 3 and represents a view looking at the left end of those Figures. The first accumulator 16 and main bore 50 are seen at the 12 o'clock and 6 o'clock positions, while the low pressure conduit and primary accumulator 17 are seen at the 9 o'clock and 3 o'clock positions. The secondary accumulator 70, shown in phantom in FIGS. 1, 2, 4 and 5 is here shown in phantom at the 8 o'clock position. The secondary accumulator 70 is connected to chambers 30, 53 via ports 71, 72 and is hydraulically isolated from the primary hydraulic system comprising accumulators 16, 17 and working chamber 51 but for the make-up valve 32 seen in FIG. 3.

The foregoing is exemplary and not intended to limit the scope of the claims which follow.

I claim:

1. An electrically controlled hydraulically powered valve actuator comprising a housing having a main bore and a main spring chamber, a high pressure source, a low pressure source, primary accumulator means, a main valve reciprocable between first and second stable positions, said main valve comprising first piston means reciprocable in said main bore to define a working chamber whose volume is minimum when said main valve is in said first stable position and maximum when said main valve is in said second stable position, said main valve further comprising second piston means in said main spring chamber which decreases the volume thereof as said main valve moves from said first stable position to said second stable position, thereby increasing the pressure of hydraulic fluid in said main spring chamber and generating a spring force toward said first stable position, an electrically controlled pilot valve reciprocable in said housing between a first stable position, wherein said pilot valve provides a connection between said high pressure source and said primary accumulator means while providing a connection between said working chamber and said low pressure source, and a second stable position, wherein said pilot valve interrupts the connection between the high pressure source and the primary accumulator means while providing a connection between said primary accumulator means and said working chamber, said main valve being driven to its second stable position by expansion of fluid in the primary accumulator means with sufficient force to overcome the opposing force generated in said spring chamber.

2. An electrically controlled hydraulically powered valve as in claim 1 further comprising secondary accumulator means hydraulically connected to said main spring chamber.

3. An electrically controlled hydraulically powered valve as in claim 1 further comprising a pilot spring chamber in said housing and a piston on said pilot valve which decreases the volume of said pilot spring chamber as said pilot valve moves from its first stable position to its second stable position, thereby increasing the pressure of hydraulic fluid in said pilot spring chamber and urging said pilot valve toward its first stable position.

4. An electrically controlled hydraulically powered valve as in claim 3 further comprising secondary accumulator means hydraulically connected to said pilot spring chamber.

5. An electrically controlled hydraulically powered valve as in claim 4 wherein said secondary accumulator means is hydraulically connected to said main spring chamber.

6. An electrically controlled hydraulically powered valve as in claim 1 further comprising a transfer port between said primary accumulator means and said working chamber, said transfer port having a check valve therein which permits hydraulic fluid to pass from said primary accumulator means to said working chamber when said pilot valve is in its second stable position.

7. An electrically controlled hydraulically powered valve as in claim 1 further comprising a make-up port hydraulically connected between said pilot spring chamber and said low pressure source, said make-up port having a check valve therein which permits hydraulic fluid to pass from said low pressure source to said pilot spring chamber.

8. An electrically controlled hydraulically powered valve as in claim 1 further comprising a main coil spring which urges said main valve from its second stable position toward its first stable position.

9. An electrically controlled hydraulically powered valve as in claim 1 further comprising a pilot coil spring which urges said pilot valve from its first stable position toward its second stable position.

10. An electrically controlled hydraulically powered valve actuator comprising a housing having a bore and a main spring chamber, a main valve reciprocable between first and second stable position, said main valve comprising first piston means reciprocable in said bore to define a working chamber whose volume is minimum when said main valve is in said first stable position and maximum when said main valve is in second stable position, said main valve further comprising second piston means in said main spring chamber which decreases the volume thereof as said main valve moves from said first stable position to said second stable position, thereby increasing the pressure of hydraulic fluid in said main spring chamber and generating a spring force toward said first stable position, an electrically controlled pilot valve reciprocable in said housing between a first stable position, wherein fluid pressure in said working chamber is relieved so that said main valve can attain its first stable position, and a second stable position, wherein fluid pressure in said working chamber is built up so that said main valve can attain its second stable position.

* * * * *